US009950232B2

(12) United States Patent
Middleton

(10) Patent No.: US 9,950,232 B2
(45) Date of Patent: Apr. 24, 2018

(54) TRAINING DEVICE FOR LIMITING THE MOVEMENT OF A PLAYER'S FOREARM DURING A SPORTING ACTION

(71) Applicant: SIMPLIFIED SPORTS PTY LTD, Orange, New South Wales (AU)

(72) Inventor: Michael Ross Middleton, Scottsdale, AZ (US)

(73) Assignee: STRAIGHTSHOOTER, LLC, Scottsdale, AZ (US)

( * ) Notice: Subject to any disclaimer, the term of this patent is extended or adjusted under 35 U.S.C. 154(b) by 0 days.

(21) Appl. No.: 15/327,993

(22) PCT Filed: Jul. 24, 2015

(86) PCT No.: PCT/AU2015/050419

§ 371 (c)(1),
(2) Date: Jan. 20, 2017

(87) PCT Pub. No.: WO2016/011510

PCT Pub. Date: Jan. 28, 2016

(65) Prior Publication Data

US 2017/0182392 A1 Jun. 29, 2017

(30) Foreign Application Priority Data

Jul. 25, 2014 (AU) ..... 2014902883

(51) Int. Cl.
*A63B 69/36* (2006.01)
*A63B 69/00* (2006.01)

(52) U.S. Cl.
CPC ..... *A63B 69/0059* (2013.01); *A63B 69/0002* (2013.01); *A63B 69/0015* (2013.01);
(Continued)

(58) Field of Classification Search
None
See application file for complete search history.

(56) References Cited

U.S. PATENT DOCUMENTS 802,623 A * 10/1905 Camp ..... A63B 69/0059 473/214
3,339,926 A 9/1967 Coupar
(Continued)

FOREIGN PATENT DOCUMENTS

WO 2008/025091 A1 3/2008

OTHER PUBLICATIONS

International Search Report (PCT/AU2015/050419); dated Oct. 23, 2015.

(Continued)

*Primary Examiner* — Nini Legesse
(74) *Attorney, Agent, or Firm* — Howard & Howard Attorneys PLLC

(57) ABSTRACT

A device for resisting and guiding a movement of a player's leading fore-arm during a sporting action. The device comprises a sleeve made of stretchable material configured to removably cover the player's forearm and upper arm, and a secondary patch of stretchable material attached to the posterior side of the sleeve. The secondary patch comprises at least two channels extending substantially along the length of the sleeve one either side of the elbow point, and which are adapted to house biasing means therein. The biasing means provide adjustable tension to resist the flexion movements of the player's fore-arm during the sporting action and maintaining the forearm in a straight, fully-extended position relative to the upper arm when the user relaxes the musculature in the forearm encased by the sleeve.

19 Claims, 6 Drawing Sheets

(52) U.S. Cl.
CPC ..... *A63B 69/0046* (2013.01); *A63B 69/3623* (2013.01); *A63B 2069/0008* (2013.01); *A63B 2209/00* (2013.01)

(56) References Cited

U.S. PATENT DOCUMENTS

| | | | | | |
|---|---|---|---|---|---|
| 3,990,709 | A * | 11/1976 | DeRogatis | A61F 5/05858 | 473/214 |
| 4,854,309 | A * | 8/1989 | Elsey | A61F 5/0118 | 602/21 |
| 5,307,521 | A * | 5/1994 | Davis | A01K 13/007 | 2/16 |
| 5,618,263 | A * | 4/1997 | Alivizatos | A61F 5/05841 | 128/878 |
| 5,695,453 | A * | 12/1997 | Neal | A61F 5/0118 | 602/21 |
| 6,322,462 | B1 * | 11/2001 | Kafer | A63B 69/0002 | 128/878 |
| 2010/0190564 | A1 * | 7/2010 | Lindby | A63B 69/0059 | 473/214 |

OTHER PUBLICATIONS

Patent Examination Report No. 1 (AU 2015292270), Date of Report: Feb. 24, 2017.

* cited by examiner

TRAINING DEVICE FOR LIMITING THE MOVEMENT OF A PLAYER'S FOREARM DURING A SPORTING ACTION

CROSS-REFERENCE TO RELATED APPLICATIONS

This application is a national stage application of PCT/AU2015/050419, filed Jul. 24, 2015, which claims priority to Australian Patent Application No. 2014902883, filed Jul. 25, 2014, the disclosures of which are hereby incorporated by reference in their entirety.

TECHNICAL FIELD

The present invention is related to devices for assisting sports players with practicing a sporting action. In particular, the present invention is essentially related to devices for extending the movement of a player's forearm during a sporting action.

The present invention can be used in relation to sporting actions including a golf swing, a roll in lawn bowls or ten pin bowling, archery, cricket bowling or any other sporting action that requires the player's arm to be substantially, fully extended during at least a portion of the action. Whilst the present invention is particularly related, but not limited, to devices for limiting the movement of a player's leading forearm during a golf swing, it has potential applications also for the golfer's following arm.

BACKGROUND ART

Many devices have been developed to assist sports players with practicing sporting actions. Particularly, due to the popularity of golf, many devices have been developed for assisting golf players in improving their swing technique.

U.S. Pat. No. 3,900,199 by Mike Gonagol, for example, discloses a rigid brace that is attached to both the forearm and the upper arm of the leading arm of a golf player to prevent the arm from bending during a golf swing.

The disclosed device is deemed both uncomfortable and restrictive since the arm is kept straight all the time and the only way for a user to bend his arm is by removing the device from the arm.

A somewhat similar restraining device is disclosed in U.S. Pat. No. 4,504,054 by E Jackson and B Myers. This device may be slightly more comfortable since it includes a pliable member that is wrapped around a user's elbow. It also includes an elongated reinforcing member which is removably housed in an open-ended casing within the pliable member. However, even if the reinforcing member is removed, the remaining pliable member would still offer resistance to the arm's movement, thus making the device somewhat inconvenient.

Substantial improvements to such devices are disclosed in U.S. Pat. Nos. 5,048,837; 5,076,587; and 5,472,206 by M Manley et al. The disclosed devices include a forearm brace and an upper arm brace connected in a pivotal point. When the pivot is locked, the golfer cannot bend his/her upper arm and elbow beyond the locked angle. However, unlocking the pivot allows a golfer to freely bend the arm. The pivot is selectively lockable by way of a stop pin which enters into a butting engagement with a corresponding surface. A sensor and an actuator can be used to move the stop pin at an appropriate time so that the golfer may simulate a professional swing, in which the elbow is locked until the ball is addressed, but is able to freely bend thereafter.

Similar arrangements have been adapted for attaching to the golfer's lead arm (U.S. Pat. No. 5,048,837) and the golfer's following arm (U.S. Pat. Nos. 5,076,587 and 5,472,206). One disadvantage with the disclosed device is that it is relatively complex and, therefore, more difficult for the user to attach it to the respective arm, and also to manufacture and maintain. In addition, while the device is able to unlock the golfer's arm during the golf swing, it seems less suitable for providing the opposite function, i.e. allowing the user to start a golf swing with an extended forearm, but allow normal flexion-extension, supination-pronation around the elbow joint, as normally occurs in a golf swing. But such functionality may be particularly useful for less advanced golfers.

In U.S. Pat. No. 3,339,926 (Coupar) a golf-swing correcting device is described that includes a brace formed of a pair of elongated telescopically arranged members and means to fasten the brace to a user's wrist and biceps so that it extends across the inside of the elbow. This configuration prevents some degree of flexion of the forearm, around the inside of the elbow joint, and requires a somewhat cumbersome means for attachment of the device to the user's arm.

One device for guiding the user's lead arm and restricting the amount of flexion at the elbow is shown in U.S. Pat. No. 5,048,837 (Manley). When using this device the golfer is unable to bend the elbow when its pivot control means is locked, and conversely the user is able to bend the elbow when the pivot control means is unlocked. Part of this device's disadvantage also appears to be that it is only axially aligned to the user's arm/forearm. No apparent supination/pronation of the forearm at the elbow joint (as is required in a golf swing) is readily achievable using this device.

United States patent publication no. 2010/0190564 (Lindy Per) discloses a support sleeve to assist a golfer in keeping their arm straight during a golf swing. This support sleeve has at least one pocket extending along the length of the sleeve, and an inserted rod retained inside at least one pocket. The sleeve is worn on the elbow region of the golfer's leading arm, and the inserted rod inhibits bending of the golfer's arm at the elbow region during a golf swing. The disadvantage of the device disclosed in this prior patent application is that the device inhibits bending of the golfer's arm at the elbow joint, which is required at the latter part of a golf swing, known generally as the 'follow-through'.

Another 'sleeve-like' device is shown in U.S. Pat. No. 8,043,163 (Proplesch). This device has two connected sections that are attached by an elastic band that lies along the back of the player's lead arm and across the elbow point (olecranon). This combination of parts that make up this device, and the need to attach multiple components of the device in use provides a time-and-dexterity disadvantage for the user. Added to this is the fact that the tension-limiting component runs across the elbow point meaning that should the normally occurring supination/pronation of the forearm around the elbow joint occur during the golf swing, some degree of discomfort is likely to occur over/around the elbow point, especially over an extended period of use.

Shown in U.S. Pat. No. 5,743,806 (Brennan) is a training device for golfers consisting of a flexible fabric sleeve and a pocket containing a lengthwise concave metallic strip positioned at the outside of the players elbow on the leading arm of the player (left arm for right handed player). Positioning the strip to the outside of the radius of flexion of the joint and over the bony protrusion of the ulna (the olecranon) as a fulcrum causes the strip to audibly deform at a small and precise degree of movement of the joint. The sleeve does not restrict flexion of the elbow, but since a straight arm non-flexed position of the arm is desirably maintained from the backswing and to the follow through, any flexion will cause the metallic strip to audibly emit a clicking sound, alerting the player to erroneous form.

A perceived disadvantage of this type of device for golfers is that it only provides audible feedback for the user, and wherein the user has to then, in a very short period of time, make a physical adjustment to the extension of the forearm around the elbow joint. This takes time and focus, which may detract from the actual rhythm of the golfer's swing, and potentially create errors in the resulting ball strike and flight.

Accordingly, it is desirable to provide an improved device for limiting the movement of a player's leading forearm during a sporting motion—especially a golf swing—that is relatively simple and easy to position and which can be adjusted easily to retain the desired amount of extension in the user's lead arm, but still allowing for requisite, and unrestrained flexion of the forearm at the elbow joint, without the user needing to think about the extension/flexion components of the swing pattern.

It is therefore an object of the present invention to provide a device that overcomes at least some of the disadvantages of previously known approaches in this field, and would therefore provide a useful alternative.

DISCLOSURE OF THE INVENTION

The above and other advantages of the present invention, which in a broad form is set out below with additional disclosure of optional and preferred aspects of the invention. These embodiments are not necessarily limiting on the invention, which is described fully in this entire document.

According to a first aspect of the present invention, there is provided a device for resisting a movement of a player's leading forearm during a sporting action. The device comprises a sleeve made of stretchable material configured to removably cover the player's forearm and upper arm, and a secondary patch of stretchable material attached to the posterior side of the sleeve. The secondary patch comprises at least two channels extending substantially along the length of the sleeve on either side of the elbow point, which is adapted to house biasing means therein. The biasing means provide adjustable tension to resist the flexion movements of the player's arm during the sporting action and maintaining the forearm in a straight, fully-extended position relative to the upper arm when the user relaxes the musculature in the forearm encased by the sleeve.

Preferably, the biasing means is a flexible rod assembly, the tension of which can be adjusted. The flexible rod assembly comprises a hollow flexible outer rod member adapted to receive a flexible inner rod member therein.

Preferably, the inner rod member further includes a threaded spigot member at one end thereof adapted to receive therein an adjusting rod having an adjusting means at the opposite end distally located from the spigot member. Most preferably, the inner rod member includes a threaded spigot member at both end thereof, each adapted to receive therein an adjusting rod having an adjusting means at the respective opposite ends distally located from the respective spigot members.

Preferably, the tension in the flexible rod assembly can be adjusted via the adjusting means. Turning the locking nut in a clockwise direction screws the adjusting rod into the threaded spigot member whereby the spigot member pulls on the flexible inner rod member thereby lengthening the respective length of the flexible inner rod member and thereby increasing the tension of the flexible rod assembly.

In a preferred embodiment, the inner and outer rod members are springs.

Preferably, the sleeve further comprises a docking-port adapted to receive the player's elbow-point therein. A portion of the sleeve pivots at or near the elbow point docking port during the flexion movements of the player's arm during the sporting action. Preferably, the flexion movements of the player's arm during the sporting action causes the biasing means to flex at or near the sleeve pivot point, thereby providing an urging force on the player's forearm to maintain a straight, fully-extended position relative to the upper arm.

Preferably, the forearm section and the upper arm section of the user are, at least partially, integrally encased in the sleeve.

According to a second aspect of the present invention, there is provided a device for preventing movement of a player's leading forearm during a sporting action, the device comprising a sleeve with an attached patch designed to enclose flexible rods in channels that run either side of the elbow point and along the back of the main sleeve, and into which the two, flexible rods are enclosed.

BRIEF DESCRIPTION OF THE DRAWINGS

A preferred embodiment of the invention will now be described, by way of example only and with reference to the accompanying drawings wherein.

BEST MODE FOR USING THE INVENTION

The training device of the present invention can be used in relation to sporting actions including a golf swing, a roll in lawn bowls, tenpin bowling, cricket or any other sporting action that requires the arm and forearm to be held in a substantially straight or extended fashion during at least a portion of the sporting action.

Figure 1:
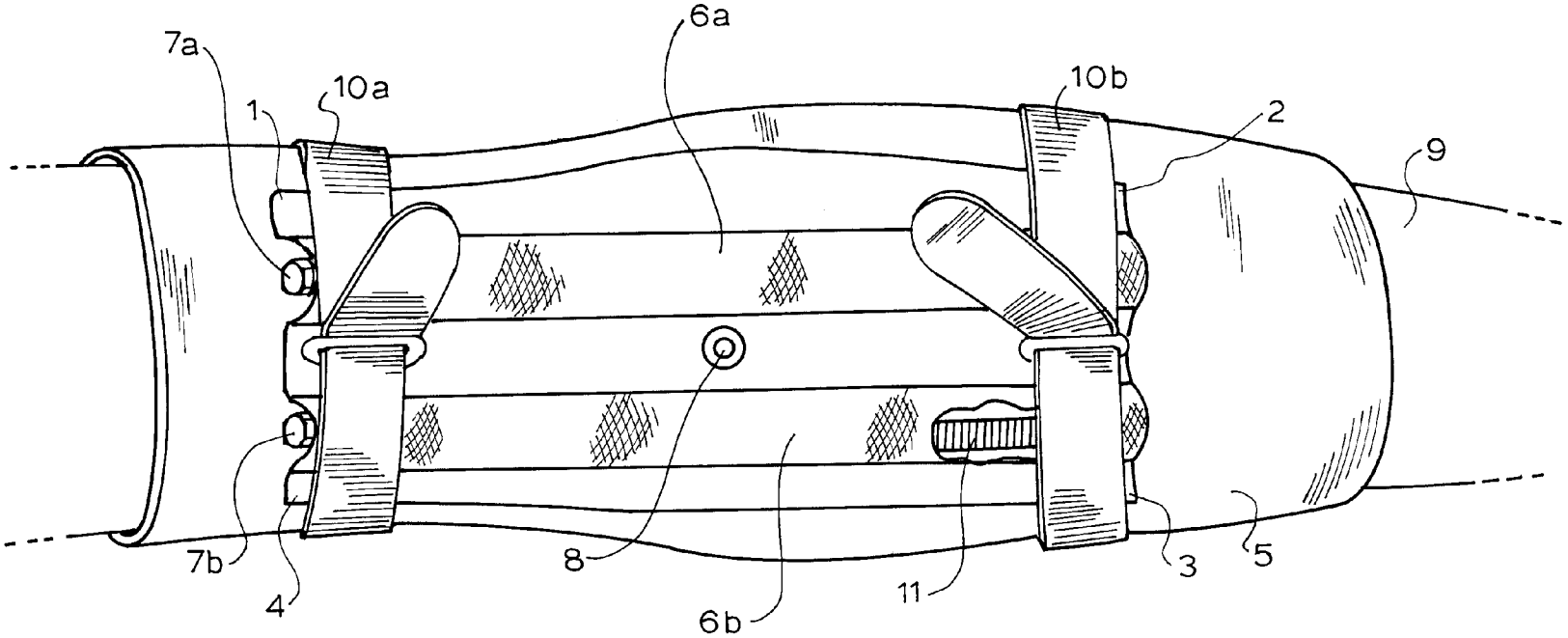
FIG. 1 is a posterior view of the training device 'sleeve' shown in a relaxed configuration, and as it would be positioned on the user's arm.
Figure 2:
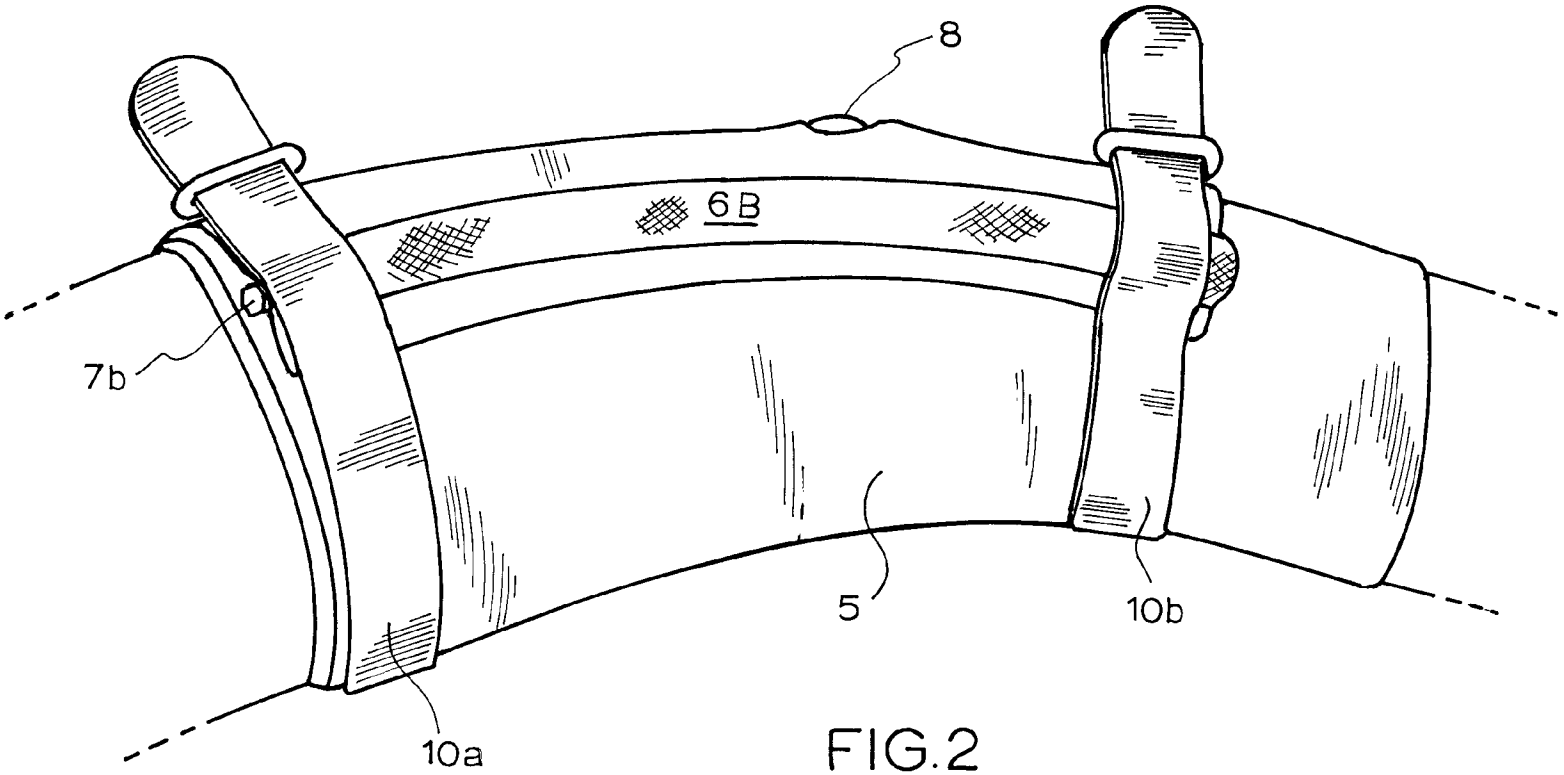
FIG. 2 is a side view of the training device shown in FIG. 1, in a partly-flexed configuration.

FIGS. 1 and 2 show a first embodiment of the training device of the present invention. The device comprises a sleeve configured so as to be easily slid into position over the user's forearm and then upper arm, and two flexible and adjustable rods (or similar devices) which keep the user's arm in a straightened or almost fully extended position, when the arm is in a relaxed mode.

FIGS. 1 and 2 show an embodiment of the present invention, which includes an 'overlaid section', or patch (1-2-3-4) with two formed channels (6A and 6B) positioned on the exterior, posterior side of the sleeve. The device comprises a generally tubular, flexible sleeve with a flexible patch positioned approximately midway along the posterior section of the sleeve (5). The material patch (1-2-3-4) is made of stretchable material and is attached to the posterior side of the device, and over the elbow-point (olecranon) of the user when in use, i.e. when the sleeve (5) is worn by a user over their forearm and upper arm. The sleeve (5) is made of a material having a degree of elasticity that allows the sleeve to be slid on to the arm of a player to the elbow region and then retain the sleeve at the desired position without slipping or falling off. Non-limiting examples of such materials can include nylon, elastic, cotton and neoprene In one preferred embodiment, as shown in FIGS. 1 and 2 the flexible rods (7*a* & 7*b*) are housed in the two channels (6A & 6B), respectively, and which traverse along most of the length of the 'overlaid, attached section of flexible material' (1-2-3-4), and aside to the elbow point, which is located and retained in an elbow-point docking-port (8).

The adjustable-tension of the flexible rods/devices (7*a* and 7*b*) keeps the training device in a substantially straightened position. Such flexible rod tension will restore the training device to the substantially straightened position if the training device is bent, or distorted away from its straightened position, as happens to the leading arm at the end of the user's 'follow-though to end of swing', when the user relaxes his/her arm over which the training device is positioned (particularly in a golf swing, for example). Adjustable tension in each rod (7*a* & 7*b*) is critical, so as to allow the extension of the lead arm to be close to fully-extended during parts of the swing which require such 'extension', but still allow the user's arm to naturally flex around the elbow joint at the end of the swing.

When in use, the training device is positioned on the arm of the person such that the elbow-point, docking-port (8) of the training device is positioned at the rear of the hinge point of the player's elbow joint.

The training device is maintained in the fully extended position by the tension in the flexible rods (7*a* & 7*b*), and as such, an arm that has the training device on it is also kept in a substantially extended position. When the forearm is flexed, the training device pivots at the elbow point located in the elbow point docking port (8), which flexes the two rods (7*a* & 7*b*), thereby increasing the tension against the flexing action of the player's forearm. Therefore, the person/user is required to exert a larger force in order to flex the forearm further and which will also further bend the flexible rods (7*a* & 7*b*), inducing a counteraction to pull the forearm back to a fully extended position. In other words, when the user bends their elbow (i.e. flexion) by moving their forearm towards their torso, the force generated by the tension in the flexible rods (7*a* & 7*b*) urges the user's forearm back into a substantially straight alignment with the user's upper arm. This 'return to fully extended arm position' can occur easily, once the user mentally 'relaxes' the tension created in the arm, and the role of the training device is played out.

Figure 3A:
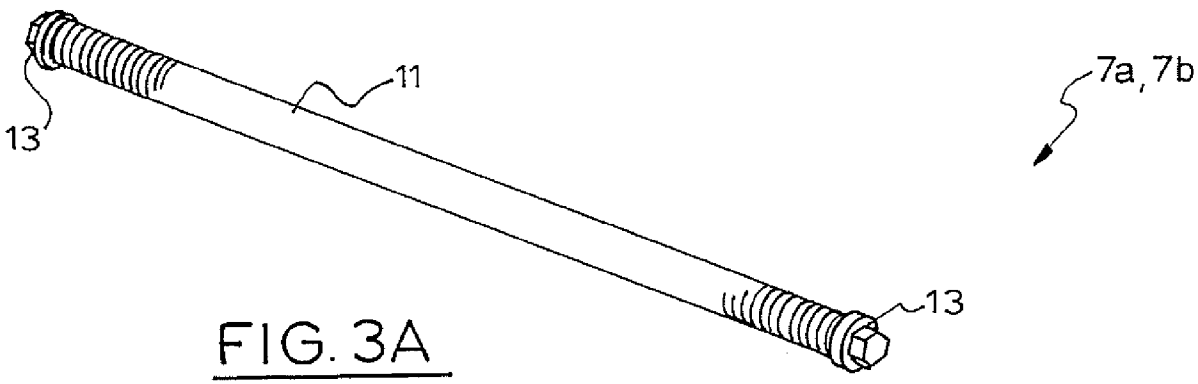
FIG. 3*a* is a perspective view of a first aspect of an embodiment of the flexible rods of the training device, showing an outer spring and associated tension-adjusting nuts.
Figure 3B:
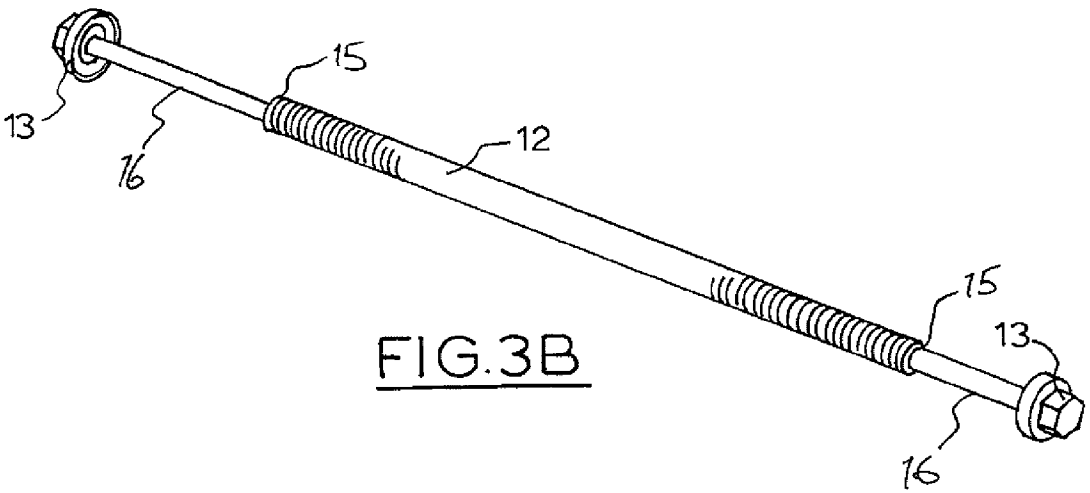
FIG. 3*b* is a perspective view of a first aspect of an embodiment of the flexible rods of the training device, showing an inner rod assembly, which sits inside the outer spring, comprising an inner spring member having spigot means, adjusting rods and associated tension-adjusting nuts.

The training device allows biasing means, provided as flexible rods/devices of differing tensions to be fitted so that it can accommodate people with different arm strengths. The flexible rods (7*a* & 7*b*) allow an increase or decrease in tension by adjusting the respective inner rod's length. By changing the dimensions of the flexible rods/devices, the tension between the upper arm and forearm can be adjusted, accordingly. This adjustability of the tension in the flexible rods (7*a* & 7*b*) is best shown in FIGS. 3A and 3B, which depict the components of each of the flexible rods (7*a* & 7*b*).

Each of the flexible rods (7*a* & 7*b*) comprise an outer rod member (11) and an inner rod member (12). The outer rod member (11) is adapted to receive the inner rod member (12). The inner rod member (12) further includes a threaded spigot member (15) at each end thereof adapted to receive an adjusting rod (16) therein. The adjusting rods (16) include an adjusting locking nut (13) on the end distally located from the spigot member (15). The adjusting locking nut (13) is adapted for the player to easily adjust, thereby also adjusting the adjusting rods to be tightened or loosened in the respective spigot members (15). In this way, the locking nuts (13) include a head designed to be turned by a tool such as a wrench, shifting spanner, socket spanner, screw driver or some other like tool. Preferably, the head of each locking nut (13) includes a hexagonal head adapted to be turned by a socket spanner.

In order for a player to increase or decrease the overall tension of the inner rod member (12), the player tightens or loosens the locking nut (13) by turning it in a clockwise or anti-clockwise direction. This movement of the locking nut (13) in turn screws the adjusting rod (16) into the spigot member (15) or screws the adjusting rod out of the spigot member. As per convention, turning the locking nut (13) in a clock-wise direction will tighten the locking nut and will screw the adjusting rod (16) into the spigot member (15).

Where the adjusting rod (16) is screwed into the spigot member (15), the spigot member pulls on the inner rod member (12), thereby increasing the respective length of the inner rod member (because it is flexible), and increasing the tension of the inner rod member. This is particularly the case where the inner rod member (12) is a spring, such that when the locking nut (13) is tightened causing the adjusting rod (16) to be screwed into the spigot member (15), the spigot member pulls on the coils of the spring, which are then expanded and the tension in the spring is increased.

To decrease the tension in the inner rod member (12), the player simply follows the reverse approach, by loosening the locking nut (13), which will in turn decrease the respective length of the flexible inner rod member (12) and decrease the tension of the flexible rod assembly.

When the inner rod member (12) is housed within the outer rod member (11), the outer rod member is retained in position over the inner rod member by frictional engagement with the rear face of each of the two adjusting locking nuts (13).

It is envisaged that the training device of the present invention will have different sizes to suit different players. The length of the flexible rods (7*a* & 7*b*) will change according to the size of the training device. For example, where the training device is suited for a child, the length of the flexible rods (7*a* & 7*b*) will be shorter compared with the length of the flexible rods where the training device is suited for an adult player. The length of the flexible rods (7*a* & 7*b*) will change to suit the size of the user and therefore the particular training device that is used. Whilst the starting tension in the different length rods will be different, the starting tension in the different length flexible rods will nevertheless be proportionally constant, as the tension has been optimized for use of the training device by a player during a sporting motion, such as a swing.

The relationship between the length and the starting tension of the flexible rods (7*a* & 7*b*) is a function of the length and the diameters of the inner and outer rod members (11 & 12), as well as the physical characteristics of the inner and outer rod members. In an especially preferred embodiment, the outer and inner rod members are springs. Certain physical properties of the two springs will also have an impact on the starting tension of the flexible rods (7*a* & 7*b*), including the wire thickness, the number of coils in the spring and the type of material from which the springs are manufactured.

This relationship can essentially be defined as follows:—

T=f [dGnD]

Where:
T=Starting Spring Tension
d=diameter of the spring wire
G=stiffness of outer and inner rod members
n=number of coils in the outer and inner springs
D=diameter of inner and outer rod members In this way, it is possible to calculate the starting tension in the outer and inner rod (spring) members (11, 12) forming the biasing means by utilizing well known force calculations, such as the following, for example:—

Extension Spring End Types

Extension Spring Design Formulas $$P=Pi+R(L-Li)$$

$$R=$$

$$P = Pi + R(L - Li)$$

$$R = \frac{Gd^4}{8nD^3}$$

$$P = Pi + RF$$

$$P=Pi+RF$$

R=Spring Rate
G=Modulus of Rigidity
d=Wire diameter
n=Number of active coils
D=Mean coil diameter
P=Load when extended to length L
Pi=Initial Tension
Li=Free Length
L=Extended Length
F=Deflection As described above, the starting tension of the flexible rods (7*a* & 7*b*) can be further adjusted by the player, which is done by tightening or loosening the adjusting locking nut (13) to adjust the tension of the inner rod member (12).

The training device also includes a docking-port (8) located in proximity to the centre of the double-thickness sleeve (FIGS. 1 and 2). The docking-port (8) is shaped to receive the player's elbow-point therein. This assists the player in correctly positioning the training device when it is fitted to the player's arm and also increases the comfort to the player when wearing the training device of the present invention.

As shown in FIG. 1, the device further includes restraining straps (10*a* and 10*b*) positioned at both ends of the sleeve, and which can be used to hold respective ends of the flexible rods (7*a* & 7*b*) onto the user's arm. Such straps are adjustable to allow for arm girth variations amongst users of the training device.

Figure 4:
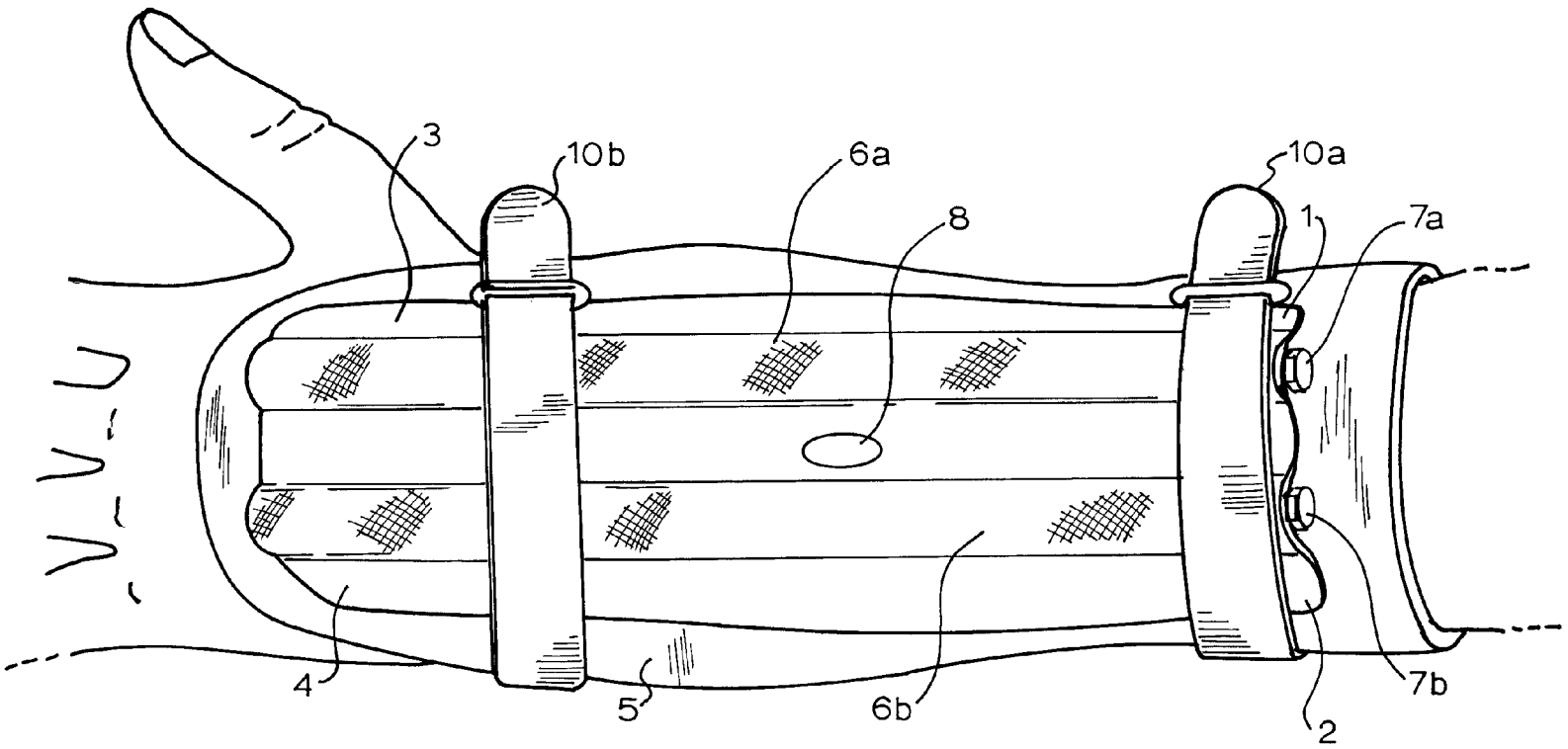
FIG. 4 is a posterior view of the training device 'sleeve' of FIG. 1 shown in a relaxed configuration, positioned on the user's arm.

FIG. 4 shows a configuration of the present invention where the sleeve (5) is placed over a user's wrist. In this configuration, where the device of the present invention is positioned over a user's wrist, the wrist end of the sleeve (5) stills project down and on the posterior side of the hand of the user's lead arm to prevent possible hyperextension of the hand at the wrist joint. To facilitate this configuration, restraining strap (10*b*) is adjustable so that it can be repositioned by being slid down the user's arm and towards the user's wrist, but still allowing the sleeve and rods to be strapped firmly to the user's wrist where it will not interfere with the grip the user has on the club/bat or other such device used when performing the sporting action, such as a swing. Obviously, in this configuration, the user's elbow will not be retained in the elbow point docking point (8).

It should be appreciated that the disclosed training device is not limited to the particular preferred embodiment described here, but also covers other arrangements using similar concepts. For example, the flexible springs are replaceable with other flexible devices such as flexible rods.

Figure 5A:
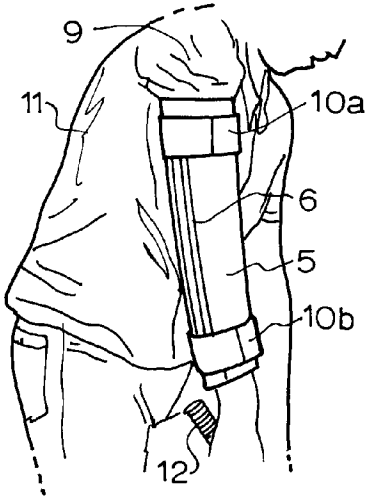
FIGS. 5*a*, 5*b*, and 5*c* show the training device of FIG. 1 in use according to a first aspect of the invention.
Figure 5B:
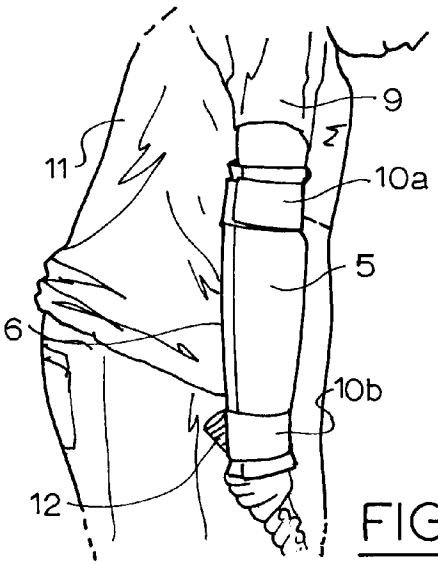
Figure 5C:
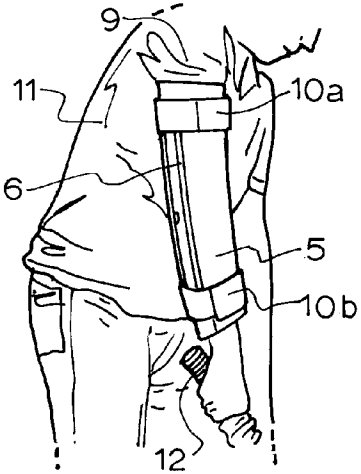
Figure 6B:
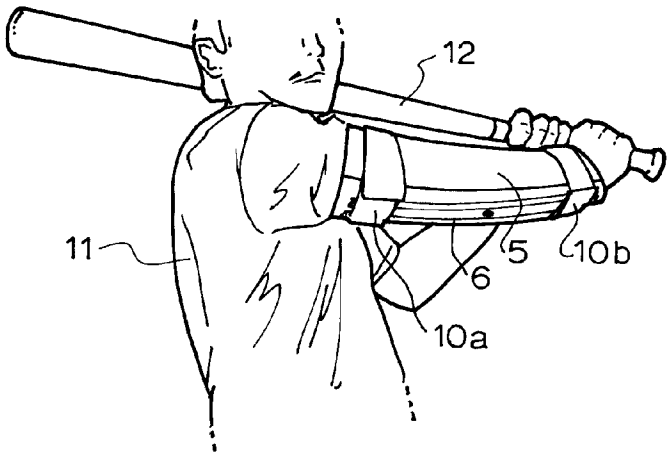
FIGS. 6*a* and 6*b* show the training device of FIG. 1 in use according to a second aspect of the invention.
Figure 6A:
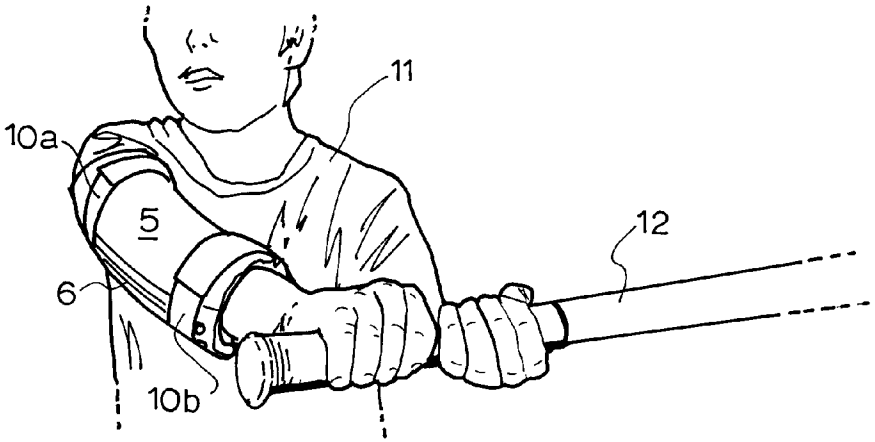

The first embodiment of the training device, shown in the drawings and described in detail in the specification is directed towards a training device, which is used for limiting the movement of a player's leading forearm during a sporting swing, with a golf swing being particularly shown in FIGS. 5*a* to 5*c* and a baseball swing being shown in FIGS. 6*a* to 6*b*.

One particular advantage of the training device of the present invention is the way the device assists in maintaining the correct straight alignment of the player's forearm with the player's upper arm during a sporting action at the necessary times (for example when the player's golf club actually makes contact with the ball), the flexibility of the sleeve (5), and particularly at the pivot point located at or near the elbow point docking-port (8), allows the player to maintain a more natural follow through of the swing, as the training device does not overly restrict or encumber the natural bending of the arm during the follow through. This means that the training device of the present invention minimizes the impact on the player's playing style, other than to provide the necessary (and desired) corrections or modifications to the sporting action (such as a golf swing) as required.

However, it should be understood that in other embodiments, not shown in the drawings, the training device can be used in any suitable sporting actions including a golf swing, a baseball strike, a roll in lawn bowls, bowling in cricket, ten pin bowling or any other sporting action that requires the arm to be substantially straight during at least a portion of the action. This could include the following arm of a golfer or sports person.

In this specification, unless the context clearly indicates otherwise, the word "comprising" is not intended to have the exclusive meaning of the word (such as "consisting only of"), but rather has the non-exclusive meaning, in the sense of "including at least". The same applies, with corresponding grammatical changes, to other forms of the word such as "comprise", etc.

It will be apparent that obvious variations or modifications may be made in accordance with the spirit of the invention that are intended to be part of the invention, and any such obvious variations or modification are therefore within the scope of the invention.

The invention claimed is:

1. A device for resisting a movement of a player's leading fore-arm during a sporting action, the device comprising:

a sleeve made of stretchable material configured to removably cover the player's fore-arm and upper arm;

biasing means for providing tension to resist flexion movements of the player's arm during the sporting action and maintaining the forearm in a straight, fully-extended position relative to the upper arm when the user relaxes musculature in the forearm encased by the sleeve, the biasing means being adjustable to provide differing levels of tension; and, a secondary patch of stretchable material attached to a posterior side of the sleeve, comprising at least two channels extending substantially along a length of the sleeve on either side of an elbow point and configured to house the biasing means therein.

2. A device according to claim 1 wherein the biasing means is a flexible rod assembly.

3. A device according to claim 2 wherein tension in the flexible rod assembly can be adjusted.

4. A device according to claim 3 wherein the flexible rod assembly comprises a hollow flexible outer rod member configured to receive a flexible inner rod member therein.

5. A device according to claim 4 wherein the inner rod member further includes a threaded spigot member at one end thereof configured to receive therein an adjusting rod, the adjusting rod including an adjusting means for adjusting tension within the flexible rod assembly, the adjusting means being located at the opposite end distally located from the spigot member.

6. A device according to claim 5 wherein the adjusting means includes a locking nut and wherein turning the locking nut in a clockwise direction screws the adjusting rod into the threaded spigot member whereby the spigot member pulls on the flexible inner rod member thereby lengthening the respective length of the flexible inner rod member and thereby increasing the tension of the flexible rod assembly.

7. A device according to claim 4 wherein the inner and outer rod members are springs.

8. A device according to claim 5 wherein the inner rod member includes a threaded spigot member at both end thereof, each configured to receive therein an adjusting rod having an adjusting means at the respective opposite ends distally located from the respective spigot members.

9. A device according to claim 1 wherein the sleeve further comprises a docking-port configured to receive the player's elbow-point therein.

10. A device according to claim 9 wherein a portion of the sleeve pivots at or near the elbow point docking port during the flexion movements of the player's fore-arm during the sporting action.

11. A device according to claim 9 wherein the flexion movements of the player's fore-arm during the sporting action causes the biasing means to flex at or near the sleeve pivot point, thereby providing an urging, guiding force on the player's forearm to maintain a straight, fully-extended position relative to the upper arm.

12. A device according to claim 1 wherein the fore-arm and the upper arm of the user are, at least partially, integrally encased in the sleeve.

13. A device for preventing movement of a player's leading fore-arm during a sporting action, the device comprising:

a sleeve having an elbow docking-port;

a patch attached to the sleeve, the patch forming a channel, the channel running along at least a portion of a posterior side of the sleeve adjacent the elbow point; and, a flexible rod assembly associated with, and being at least partly enclosed by the channel, the flexible rod assembly having an associated tension, the associated tension being adjustable.

14. A device according to claim 13 wherein the flexible rod assembly comprises a hollow flexible outer rod member configured to receive a flexible inner rod member therein.

15. A device according to claim 14 wherein the inner rod member further includes a threaded spigot member at one end thereof configured to receive therein an adjusting rod.

16. A device according to claim 15 further comprising a locking nut coupled to the adjusted rod, wherein turning the locking nut in a clockwise direction screws the adjusting rod into the threaded spigot member whereby the spigot member pulls on the flexible inner rod member thereby lengthening the respective length of the flexible inner rod member and thereby increasing the tension of the flexible rod assembly.

17. A device according to claim 14 wherein the inner and outer rod members are springs.

18. A device according to claim 13 wherein the sleeve further comprises a docking-port configured to receive the player's elbow-point therein.

19. A device according to claim 13 wherein the fore-arm and an upper arm of the player are, at least partially, integrally encased in the sleeve.

* * * * *